US009456951B2

(12) United States Patent
Stevenot et al.

(10) Patent No.: US 9,456,951 B2
(45) Date of Patent: Oct. 4, 2016

(54) APPARATUS FOR CLOSED KINETIC CHAIN MUSCLE STRENGTHENING AND/OR REHABILITATION OF THE SHOULDER JOINT AND OF THE UPPER LIMB

(75) Inventors: Thierry Stevenot, Charleville-Mezieres (FR); Mathias Lubin, Saint Laurent (FR)

(73) Assignee: EUROPHYSEO, Charleville-Mezieres (FR)

( * ) Notice: Subject to any disclaimer, the term of this patent is extended or adjusted under 35 U.S.C. 154(b) by 703 days.

(21) Appl. No.: 13/876,576

(22) PCT Filed: Aug. 31, 2011

(86) PCT No.: PCT/FR2011/051998

§ 371 (c)(1),
(2), (4) Date: Mar. 28, 2013

(87) PCT Pub. No.: WO2012/045934

PCT Pub. Date: Apr. 12, 2012

(65) Prior Publication Data

US 2013/0190662 A1 Jul. 25, 2013

(30) Foreign Application Priority Data

Sep. 28, 2010 (FR) ..... 10 57813

(51) Int. Cl.

| | |
|---|---|
| ***A61H 1/02*** | (2006.01) |
| ***A63B 23/12*** | (2006.01) |
| ***A63B 23/035*** | (2006.01) |
| *A63B 21/005* | (2006.01) |
| *A63B 21/008* | (2006.01) |
| *A63B 21/02* | (2006.01) |

(52) U.S. Cl.

CPC ..... *A61H 1/0281* (2013.01); *A63B 21/4035* (2015.10); *A63B 21/4045* (2015.10); *A63B 23/03508* (2013.01); *A63B 23/1245* (2013.01); *A63B 21/0058* (2013.01); *A63B 21/0083* (2013.01); *A63B 21/0087* (2013.01); *A63B 21/023* (2013.01); *A63B 2208/0233* (2013.01)

(58) Field of Classification Search

CPC ..... A61H 1/0281; A61H 1/0274; A63B 23/1245; A63B 21/023; A63B 23/03508; A63B 21/4035; A63B 21/0058; A63B 21/0083; A63B 21/0087; A63B 2008/0233

See application file for complete search history.

(56) References Cited

U.S. PATENT DOCUMENTS 4,817,943 A 4/1989 Pipasik
5,163,451 A * 11/1992 Grellas ..... A61H 1/0274 128/898

(Continued)

FOREIGN PATENT DOCUMENTS

FR 2674136 A1 9/1992

*Primary Examiner* — Justine Yu
*Assistant Examiner* — Timothy Stanis
(74) *Attorney, Agent, or Firm* — Andrew W. Chu; Craft Chu PLLC

(57) ABSTRACT

An apparatus for closed kinetic chain muscle strengthening and/or rehabilitation of the shoulder joint and of the upper limb includes a device for positioning the user or patient, a working assembly having a resistor, allowing the user or patient to exert efforts, support device which connects the working assembly to the positioning device, and which is fitted with an adjustor for positioning and orienting the working assembly in space. The support device and also the adjustor are configured such that the resistor can be positioned, relative to the user or patient, above and laterally on the side of the limb to be worked, which is positioned outstretched, raised in the plane of the scapula until it is along the extension of the subcutaneous part of the spine of the scapula.

20 Claims, 2 Drawing Sheets

(56) References Cited

U.S. PATENT DOCUMENTS 5,179,939 A * 1/1993 Donovan ..... A61H 1/0281 482/4
5,417,643 A * 5/1995 Taylor ..... A61H 1/0274 601/24
5,830,160 A 11/1998 Reinkensmeyer
6,227,047 B1 5/2001 Livingston
7,621,857 B2 * 11/2009 Pompile ..... A63B 21/0552 482/129
2003/0130600 A1 * 7/2003 Branch ..... A61H 1/0281 601/5
2004/0082437 A1 4/2004 Dvir
2007/0037677 A1 * 2/2007 Splane ..... A63B 21/4047 482/121

* cited by examiner

APPARATUS FOR CLOSED KINETIC CHAIN MUSCLE STRENGTHENING AND/OR REHABILITATION OF THE SHOULDER JOINT AND OF THE UPPER LIMB

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an apparatus for closed kinetic chain muscle strengthening and/or rehabilitation of the shoulder joint and the upper limb.

2. Description of Related Art Including Information Disclosed Under 37 CFR 1.97 and 37 CFR 1.98.

It has been observed that the pathologies of the deep tendons of the shoulder (rotator cuff) are very frequent, and that the ultimate evolution of this tendinous pathology is the fracture.

Studies have shown that up to the age of 70 years, 50% of the persons suffer from a fracture of the cuff and that at the age of 80 years, it reaches 70%. The therapists are thus daily faced with this kind of pathologies, and the aging of the population increases the frequency of this problem.

Most of the time, the upper limb is used by the person in an open kinetic chain, the hand remaining movable. This use of the upper limb in an open kinetic chain highly stresses the muscles of the rotator cuff and favors the decentering, which in the end cause evolutionary tendinous lesions.

In order to cope with these problems, open kinetic chain rehabilitation techniques are carried out, which, though they are indispensable, have however drawbacks. The open kinetic chain strengthening of the depressor muscles favor the decentering, and the strengthening of the lateral rotators produces deleterious stresses in the supraspinatus.

The present applicants have observed that the closed kinetic chain load of the upper limb permits, under certain circumstances, to take part in the re-centering of a decentered head of humerus. From this observation resulted a new closed kinetic chain active glenohumeral re-centering technique guided by the practitioner.

According to this technique, the patient raises the arm in the plane of the scapula, or slightly in front of this plane, until it is located in the extension of the subcutaneous portion of the spine of the scapula, eventually a little below if the position is painful or uncomfortable. This permits with certainty to have between the plane of the glene (articular surface of the scapula) and the axis of the diaphysis of the humerus, an angle (open outside and below) larger than 90°. In some cases, namely when the anterior decentering of the head of the humerus on the scapular glene is important, the position of the upper limb will be slightly changed. The arm will then be raised in flexion or in an intermediate position between the flexion and the abduction in the plane of the scapula.

The adequate position is determined by the practitioner, and once it has been reached, the latter firmly holds the patient's hand and asks him to perform traction or pushing movements, successively and/or alternately, preferably without either flexing the elbow or raising the shoulder, and maintaining the contraction during a determined period of time.

This rehabilitation technique provides good results, but its implementation has some drawbacks, and namely in that it permanently requires the practitioner's participation. This closed-chain work corrects the decentering of the glenohumeral joint.

In order to cope with these drawbacks, an apparatus for closed kinetic chain muscle strengthening and/or rehabilitation of the shoulder joint and the upper limb is provided, which permits the implementation of the active re-centering technique without intervention by the practitioner, except for its placing and monitoring, and which permits a work performed in a repetitive, quantified and measured way. It should be noted that this apparatus is not only for rehabilitation work, since it is also usable for preventive or muscle-training purposes.

It should be noted that apparatuses for muscle strengthening and/or rehabilitation of the shoulder joint and the upper limb are already known. All these apparatuses include means for positioning the user or patient, a working assembly comprising resisting means enabling the user or patient to exert efforts, support means that connect said working assembly to said positioning means, and provided with adjusting means permitting to position and orientate said working assembly in space.

This is for example the case for U.S. Pat. No. 5,830,160, which describes an apparatus for evaluating the performance of a movement, by measuring the stress forces generated during a movement guided along a desired path. This apparatus, which is in particular intended for the rehabilitation of persons suffering from brain damage, cannot allow the implementation of the above-mentioned technique, since it does not allow making efforts with a stretched or slightly flexed arm, in a particular direction, and in particular in the extension of the subcutaneous portion of the spine of the scapula.

U.S. 2004/082437 describes an apparatus permitting to extract isokinetic measures from the torque applied by part of the body, the latter performing a pivoting or flexing movement at a given angular speed about an effective pivoting axis. Even if transformed to permit working along the axis, this apparatus would not permit to implement the above-mentioned technique.

U.S. Pat. No. 6,227,047 describes an apparatus comprising an adjustable horizontal arm coupled to a vertical element on which it adjusts vertically. The horizontal arm is provided with isokinetic measuring means. This apparatus does not permit a user or patient to position its arm according to the prescribed angle to perform the work required in the above-mentioned technique.

U.S. Pat. No. 4,817,943 relates to a physical exercise apparatus designed for developing the muscles of the shoulders. This apparatus permits the user to carry out shoulder rotation exercises with flexed arms, and it is neither adapted nor adaptable to the implementation of the above-mentioned technique.

FR 2 674 136 provides a shoulder rehabilitation device, in order to ensure a pivoting movement of the joint about a determined axis, while exerting on the limb an adjustable pulling force so as to perform a distraction of the joint. This device does not permit to implement the above-mentioned technique, and in addition it produces opposite effects, since it leads to exert a pulling force on the joint.

None of the apparatuses for muscle strengthening and/or rehabilitation of the shoulder joint and the upper limb known hitherto permits to implement the above-mentioned rehabilitation technique.

SUMMARY OF THE INVENTION

The apparatus for closed kinetic chain muscle strengthening and/or rehabilitation of the shoulder joint and the upper limb according to the invention includes means for positioning the user or patient, a working assembly comprising resisting means enabling the user or patient to exert efforts, support means that connect said working assembly to said positioning means, and provided with adjusting means permitting to position and orientate said working assembly in space, and it is essentially characterized in that:

said resisting means are associated with a gripping means aimed at being seized by the user or patient in order to enable him to exert in closed chain said compression or pulling efforts against said resisting means, said support means as well as said adjusting means are shaped so that said resisting means can be positioned, with respect to the user or patient, above and laterally with respect to the side of the limb to be worked, and so that the direction in which said compression or pulling efforts must be exerted is on the axis of said limb, while the latter is positioned stretched, raised in the plane of the scapula, until it is located in the extension of the subcutaneous portion of the spine of the scapula, and that said working assembly is at a distance permitting that said compression or pulling efforts can be performed with a stretched or slightly flexed arm.

It should be noted that the initial positioning of the arm is performed by the practitioner, and that the latter can estimate, according to the diagnostic balance he previously made, that the arm must not be positioned exactly in the plane of the scapula, but slightly in front of this plane.

According to an additional feature of the apparatus according to the invention, the support means consist of an arm designed capable of being orientated angularly with respect to the maintaining and positioning means, and at the distal end of which the working assembly can be displaced axially and in axial pivoting, with the possibility of immobilization in the position being chosen.

According to an additional feature of the apparatus according to the invention, the resisting means are mounted movable in pivoting on the working assembly, according to an axis perpendicular to the direction of the pulling or compression efforts, which can be exerted on said resisting means.

According to another additional feature of the apparatus according to the invention, the means for positioning the user or patient comprise a frame, which the support means are made integral with, and include, on the one hand, marking means permitting to place the user or patient with respect to said support means and, on the other hand, maintaining means permitting to immobilize said user or patient, or that said user or patient can immobilize himself, in order to permit him to make his exercises.

According to another additional feature of the apparatus according to the invention, the positioning means comprise a platform on which the user or patient sits to make his exercises.

According to another additional feature of the apparatus according to the invention, the maintaining means consist of a handle aimed at being seized by the user or patient with his free hand.

According to another additional feature of the apparatus according to the invention, the resisting means are associated with means for adjusting their hardness.

According to another additional feature of the apparatus according to the invention, the resisting means are associated with means for measuring the exerted efforts.

According to another additional feature of the apparatus according to the invention, the resisting means consist of a hydraulic, pneumatic or spring jack.

According to another additional feature of the apparatus according to the invention, the resisting means consist of driving means capable of translating the gripping means.

The advantages and features of the apparatus according to the invention will become clear from the following description, which relates to the attached drawing, which represents a non-restrictive embodiment of same.

DETAILED DESCRIPTION OF THE DRAWINGS

Figure 1:
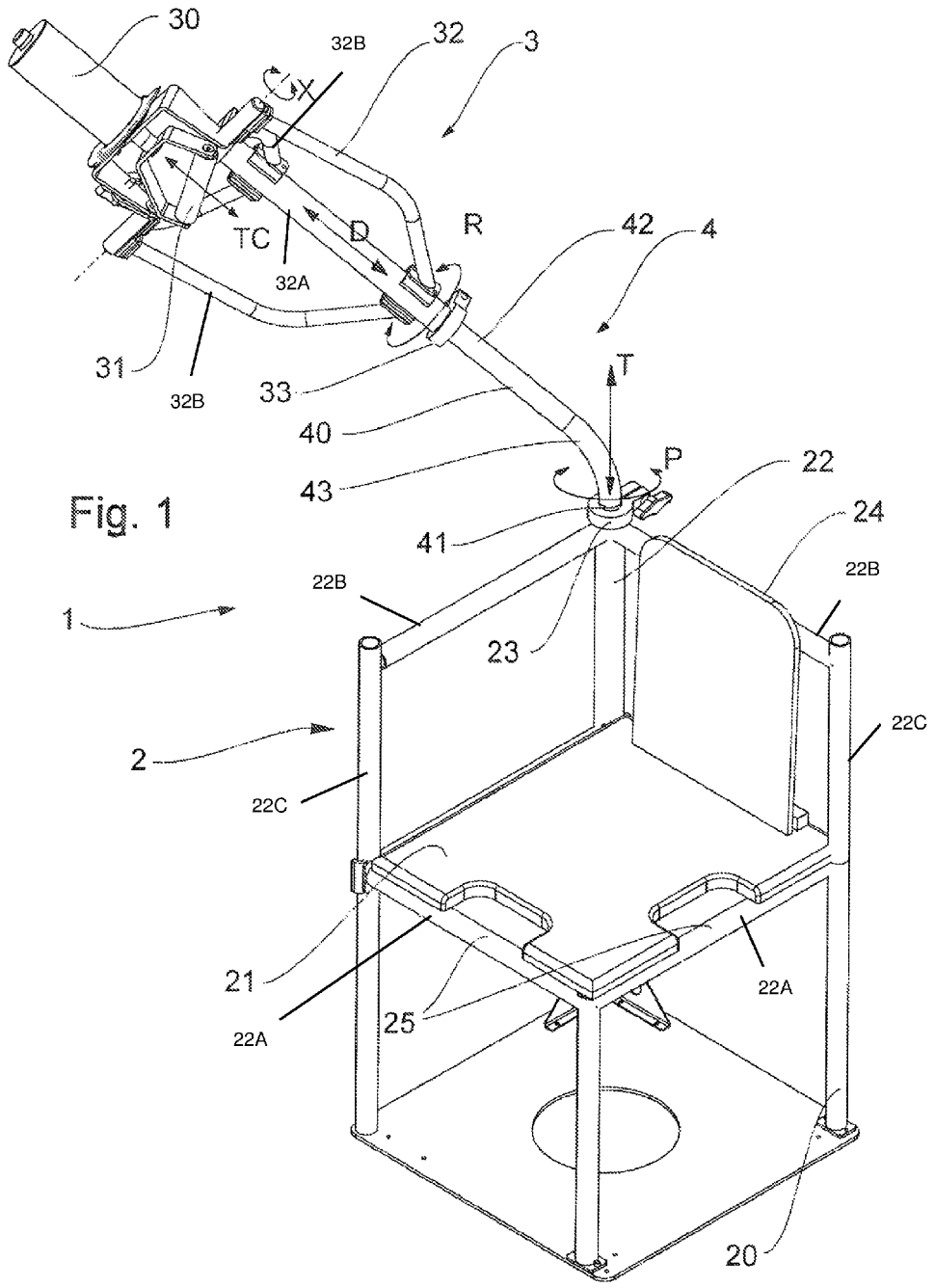
FIG. 1 represents a schematic perspective view of an apparatus according to the invention.
Figure 2:
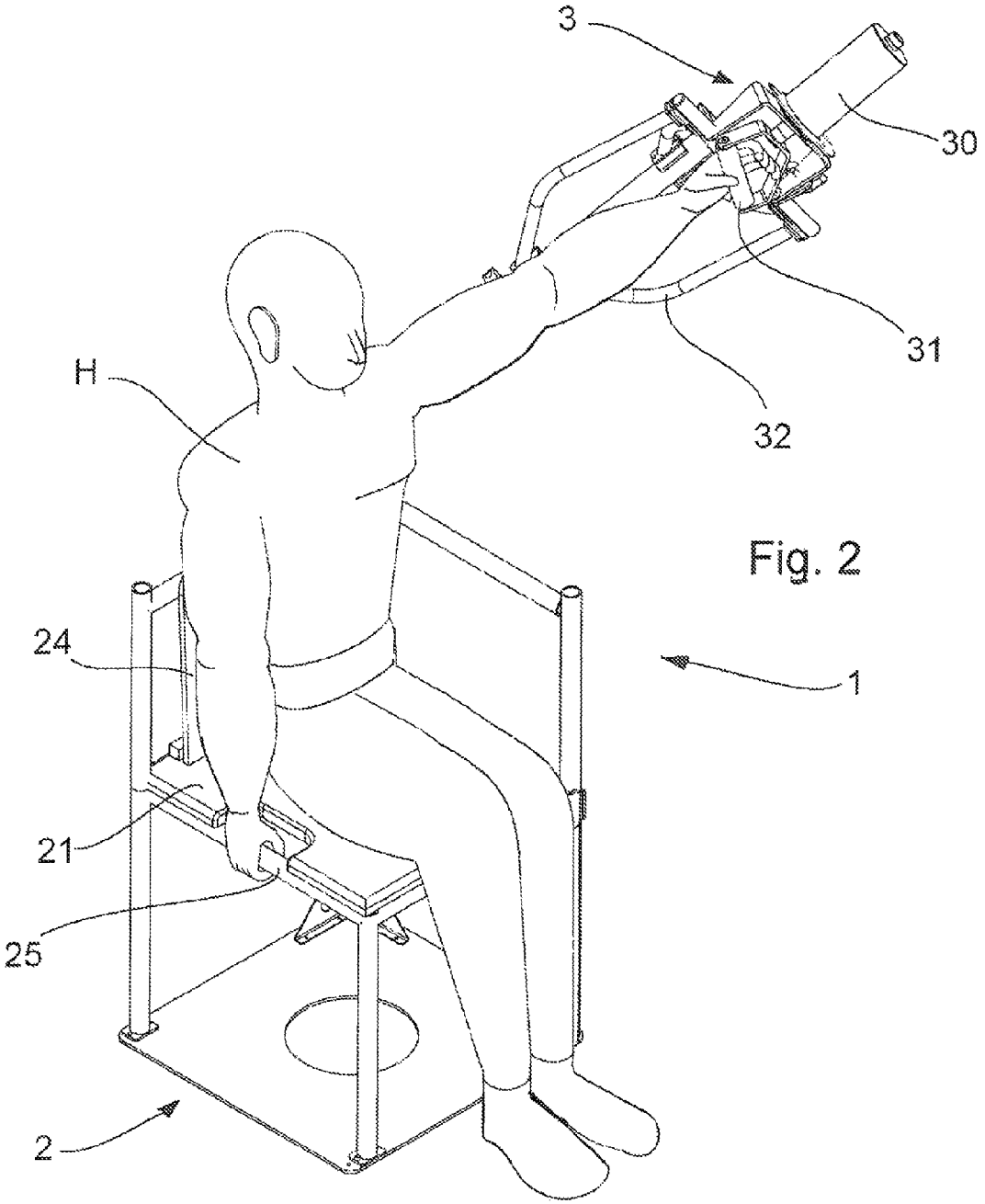
FIG. 2 represents a schematic perspective view of the same apparatus during use.

When referring to these FIGS. 1 and 2, one can see an apparatus 1 for closed kinetic chain muscle strengthening and/or rehabilitation of the shoulder joint and the upper limb according to the invention, aimed at permitting the rehabilitation of the shoulder of a user or patient H, and in particular the implementation of the active glenohumeral re-centering technique described above, without intervention by the practitioner, except for the installation of the user or patient H and his monitoring.

This apparatus 1 includes a chair 2 permitting the installation of the user or patient H in the right position for making the rehabilitation exercises. This chair 2 essentially comprises a frame 20 and a horizontal platform 21 on which the user or patient H sits.

It should be noted that, according to a variant, not shown, of the rehabilitation apparatus according to the invention, the rehabilitation exercises can be made while standing by the user or patient H.

The apparatus 1 also includes a working assembly 3 connected to the chair 2 through support means 4.

The working assembly 3 comprises resisting means 30 such as, non-restrictively, hydraulic, pneumatic or spring jack, associated with a handle 31 aimed at being seized in order to permit to exert pulling or compression efforts against the resisting means 30 according to the double arrow TC, and a framework 32 on which the resisting means 30 are fixed.

It should be noted that the resisting means can consist of driving means capable of displacing the handle 31 according to TC, the efforts then being made in resistance to the displacements.

The support means 4 are intended for supporting the working assembly 3 and for positioning it at the adequate location for the user or patient H to be capable of making his rehabilitation exercises in an optimal way.

The support means 4 consist of an arm 40 made integral with the frame 20 of the chair 2, which comprises three portions, namely two rectilinear end portions, a first end portion 41 and a second end portion 42 connected by an intermediate portion 43 forming a bend. The first rectilinear portion 41 is inserted vertically in a vertical tube 22 of the frame 20 or it can pivot therein and translate therein longitudinally, according to the arrows T and P, respectively, with locking possibility by means of a flange 23, while the second rectilinear portion 42 carries the frame 32 of the working assembly 3, which can pivot and move on the second rectilinear portion 42, according to the arrows D and R, respectively, with locking possibility by means of a flange 33, and the intermediate curved portion 43 is intended for providing the rectilinear portion 42 with an oblique orientation.

On the other hand, the resisting means 30 are mounted movable in pivoting on the frame or framework 32 comprised of a center post 32A and side posts 32B, according to an axis X perpendicular to the axis of displacement of the handle 31 according to TC.

The various adjustments permitted by the support means are aimed at permitting to position and orient the resisting means 30 with respect to the arm of the user or patient H, which is arranged stretched obliquely in a position determined by the practitioner, and so that the direction TC of the efforts is on the axis of the arm. And in particular so that between the plane of the glene (articular surface of the scapula) and the axis of the diaphysis of the humerus is created an angle larger than 90°.

After performing the adjustments, the user or patient H can seize the handle 31 and exert compression or pulling movements against the resisting means 30, while maintaining the arm stretched, eventually slightly flexed.

As can be seen in FIG. 2, with respect to FIG. 1, the various adjustments also permit to treat the left shoulder or the right shoulder by displacing the working assembly 3 through pivoting according to P of the rectilinear portion 41 of the arm 40, while the user or patient previously positioned himself so that his shoulder to be treated is in front of the tube 22.

In this respect, it should be noted that, in order to permit this transition, the chair or positioning means 2 is formed so as to be reversible, in this case it includes a back or seat back 24 that can be displaced on either of both sides adjacent to the center vertical tube 22 from a first set of horizontal tubes 22A and extended to a second set of horizontal tubes 22B, and the seat or seat platform 21 includes, at the edge on each of these two sides opposite the tube 22 and on a first set of horizontal tubes 22A, a handle or handle portions 25 aimed at being seized by the user or patient H with his free hand, so as to ensure its stability in reaction to the effort made during the performing of the exercises Optionally, the resisting means 30 have an adjustable hardness. On the other hand, they can also include means for measuring the efforts made, such as dynamometric efforts or the like. These measuring means are preferably arranged at the level of the resisting means 30, and visibly for the user or patient H, who can thus verify the quality of his work and, in the case of an isometric work, visualize the level of effort he has to maintain for a determined period of time.

The rehabilitation apparatus 1 according to the invention permits that a user or patient H can continuously or alternately make pulling or compression efforts of the shoulder in closed kinetic en chain without shearing of the muscles of the rotator cuff.

The active work of the user, who will pull or push the handle 25 that is almost fixed, will generate compression stresses on the joint, and centripetal forces of the musculature on the head of the humerus and the periphery of the glene.

These compression stresses will then, under these exact circumstances, cause a sliding of the head of the humerus downwardly and rearwardly, then correcting the anterior and upper decentering component of the head of the humerus on the glene. The centripetal forces improve this phenomenon.

More specifically, during the pulling work occurs in addition a contraction of the pectoralis major, latissimus dorsi and teres major muscles, which cause, in this particular situation, an articular compression and an automatic medial rotation, which corrects the rotatory decentering component, referred to as retroversion of the head of the humerus (or spin in medial rotation). This third decentering component is corrected through the association of three movements, downward, rearward and in medial rotation, of the head of the humerus on the glene of the scapula. It is essential, in the treatment of the pathologies of the rotator cuff of the shoulder, to correct these decenterings, because the consequence is a conflict between the tendons of the rotator cuff and the acromio-coracoidian osteo-ligamentous arch. The apparatus according to the invention permits to correct these decenterings, to actively re-center the head of the humerus on the glene, and to globally reinforce the cuff, without rotation, thus without shear stress in the tendon of the supraspinatus.

What is claimed:

1. An apparatus for closed kinetic chain exercises for a shoulder joint and an upper limb of a patient, said apparatus comprising:

a positioning means being comprised of a frame with a center vertical tube;

a support means comprising:

an arm being comprised of a first end portion at least partially housed in said center vertical tube, an intermediate portion connected to said first end portion, a second end portion connected to said intermediate portion, said intermediate portion being between said first end portion and said second end portion, said intermediate portion being bent, said second end portion being angled from vertical relative to said first end portion within said center vertical tube; and a first flange engaged to said first end portion and said center vertical tube; and a working assembly comprising:

a framework being comprised of a center post and side posts, said center post being aligned with said arm and rotatable relative to said second end portion;

a second flange engaged to a proximal end of said center post and connected to said second end portion;

a resisting means connected to a distal end of said center post; and a handle connected to said resisting means, said handle having movement away from said resisting means and towards said support means, said movement being parallel to said center post.

2. The apparatus for closed kinetic chain exercises, according to claim 1, wherein said frame further comprises horizontal tubes and vertical tubes, wherein said positioning means further comprises:

a seat platform positioned on a first set of horizontal tubes;

a seat back extending upward from said first set of horizontal tubes to a second set of horizontal tubes; and handle portions on the first set of horizontal tubes, wherein said seat back is positioned relative to each handle portion according to a position of said working assembly relative to said second set of horizontal tubes and said center vertical tube.

3. The apparatus for closed kinetic chain exercises, according to claim 2, said second end portion being angled upward from said second set of horizontal tubes by said intermediate portion and rotated outside said second set of horizontal tubes in a working configuration.

4. The apparatus for closed kinetic chain exercises, according to claim 3, said second end portion forming an angle of more than 90 degrees with said seat back.

5. The apparatus for closed kinetic chain exercises, according to claim 3, wherein said handle moves relative to said resisting means parallel to said center post, said second end portion being in said working configuration.

6. The apparatus for closed kinetic chain exercises, according to claim 1, wherein said first flange locks said second end portion relative to said positioning means.

7. The apparatus for closed kinetic chain exercises, according to claim 6, said first end portion having an adjustable height relative to said positioning means.

8. The apparatus for closed kinetic chain exercises, according to claim 6, said first end portion having an adjustable rotation relative to said positioning means.

9. The apparatus for closed kinetic chain exercises, according to claim 1, wherein said second flange locks said center post relative to said second end portion.

10. The apparatus for closed kinetic chain exercises, according to claim 1, wherein said handle moves relative to said resisting means parallel to said center post.

11. The apparatus for closed kinetic chain exercises, according to claim 1, wherein said resisting means has a variable resistance level against movement of said handle away from said resisting means.

12. The apparatus for closed kinetic chain exercises, according to claim 1, further comprising: a measurement means connected to said resisting means so as to determine force exerted on said resisting means.

13. The apparatus for closed kinetic chain exercises, according to claim 1, wherein said resisting means is a jack, said jack being selected from a group consisting of: a hydraulic jack, pneumatic jack, and a spring jack.

14. The apparatus for closed kinetic chain exercises, according to claim 1, wherein said resisting means has a variable resistance level against movement of said handle toward said resisting means.

15. An apparatus for closed kinetic chain exercises for a shoulder joint and an upper limb of a patient, said apparatus comprising:

a positioning means comprising:

a frame being comprised of a center vertical tube, horizontal tubes and vertical tubes;

a seat platform positioned on a first set of horizontal tubes;

a seat back extending upward from said first set of horizontal tubes to a second set of horizontal tubes; and handle portions on the first set of horizontal tubes;

a support means comprising:

an arm being comprised of a first end portion at least partially housed in said center vertical tube, an intermediate portion connected to said end portion, a second end portion connected to said intermediate portion, said intermediate portion being between said first end portion and said second end portion, said intermediate portion being bent, said second end portion being angled from vertical relative to said first end portion within said center vertical tube; and a first flange engaged to said first end portion and said center vertical tube; and a working assembly comprising:

a framework being comprised of a center post and side posts, said center post being aligned with said second end portion and rotatable relative to said second end portion;

a second flange engaged to a proximal end of said center post and connected to said second end portion;

a resisting means connected to a distal end of said center post; and a handle connected to said resisting means, said handle having movement away from said resisting means and towards said support means, said movement being parallel to said center post.

16. The apparatus for closed kinetic chain exercises, according to claim 15, wherein said seat back is positioned relative to each handle portion according to a position of said working assembly relative to said second set of horizontal tubes and said center vertical tube.

17. The apparatus for closed kinetic chain exercises, according to claim 15, wherein said first flange locks said second end portion relative to said frame.

18. The apparatus for closed kinetic chain exercises, according to claim 15, said second end portion being angled upward from said second set of horizontal tubes by said intermediate portion and rotated outside said second set of horizontal tubes in a working configuration.

19. The apparatus for closed kinetic chain exercises, according to claim 18, wherein said handle moves relative to said resisting means parallel to said center post, said second end portion being in said working configuration.

20. The apparatus for closed kinetic chain exercises, according to claim 15, wherein said handle moves relative to said resisting means parallel to said center post.

* * * * *